US006742820B2

(12) United States Patent
Shen

(10) Patent No.: US 6,742,820 B2
(45) Date of Patent: Jun. 1, 2004

(54) EASY-TO-OPERATE CYLINDRICAL LOCK

(76) Inventor: Mu-Lin Shen, No. 32, Lane 76, Fu-An Road, Sec. 5, Tainan (TW)

( * ) Notice: Subject to any disclaimer, the term of this patent is extended or adjusted under 35 U.S.C. 154(b) by 0 days.

(21) Appl. No.: 10/185,549

(22) Filed: Jun. 28, 2002

(65) Prior Publication Data

US 2004/0000795 A1 Jan. 1, 2004

(51) Int. Cl.[7] ..... E05B 3/00

(52) U.S. Cl. ..... 292/336.3; 292/DIG. 63; 292/347; 292/348; 292/357

(58) Field of Search ..... 292/336.3, 347, 292/348, 92, 357, 169, 165, DIG. 63; 70/209, 224, 465, 462, 92; 16/430

(56) References Cited

U.S. PATENT DOCUMENTS 3,965,528 A * 6/1976 Kissler ..... 16/110.1
4,018,465 A * 4/1977 Ramler ..... 292/336.3
4,676,083 A * 6/1987 Sedley et al. ..... 70/276
4,913,479 A * 4/1990 Allison ..... 292/347
5,177,987 A * 1/1993 Shen ..... 70/224
5,286,074 A * 2/1994 Lin ..... 292/336.3
5,385,374 A * 1/1995 Fann et al. ..... 292/336.3
5,605,064 A * 2/1997 Katayama et al. ..... 70/224
5,638,576 A * 6/1997 Mutone ..... 16/413
5,718,468 A * 2/1998 Qureshi et al. ..... 292/347
5,794,472 A * 8/1998 Kester et al. ..... 70/472
5,904,232 A * 5/1999 Shen ..... 192/69.62
6,131,970 A * 10/2000 Hurst et al. ..... 292/336.3
6,279,360 B1 * 8/2001 Shen ..... 70/224
6,289,557 B1 * 9/2001 Manson et al. ..... 16/412
6,425,273 B1 * 7/2002 Kim et al. ..... 70/224

* cited by examiner

*Primary Examiner*—Robert J. Sandy
*Assistant Examiner*—Dinesh N Melwani
(74) *Attorney, Agent, or Firm*—Alan Kamrath

(57) ABSTRACT

A lock includes an inner assembly, an outer assembly, and a latch mechanism. The inner assembly includes an inside lever handle, an inside spindle, and an inside rose. The outer assembly includes an outside lever handle, an outside spindle, and an outside rose liner from which two engaging posts extend. The latch mechanism includes a housing and a latch bolt. A reinforcing plate includes two pegs respectively extending through two positioning holes of the housing. The reinforcing plate further includes a central hole through which the outside spindle extends. The reinforcing plate further includes a pair of slots through which the engaging posts extend. Two fasteners are extended through the inside rose liner and engaged with the engaging posts. Each of the inside lever handle and the outside lever handle are located in a position that inclines upward and at 45 degrees with a horizontal axis.

12 Claims, 9 Drawing Sheets

EASY-TO-OPERATE CYLINDRICAL LOCK

BACKGROUND OF THE INVENTION

1. Field of the Invention

The present invention relates to an easy-to-operate cylindrical lock. In particular, the present invention relates to a cylindrical lock that is easy-to-operate for people that are handicapped in the hands or without hands.

2. Description of the Related Art

FIGS. 1 through 3 of the drawings illustrate a conventional cylindrical lock comprising an inner assembly 1, an outer assembly 2, and a latch mechanism 3. The inner assembly 1 includes an inside lever handle 11, an inside rose 12, an inside rose liner 13, and an inside spindle 15. The outer assembly 2 includes an outside lever handle 21, an outside rose 22, an outside rose liner 23, and an outside spindle 25. Two engaging posts 24 are mounted to an inner side of the outside rose liner 23.

The latch mechanism 3 is mounted in a door 8 and includes a housing 30 and a latch bolt 31. A cam 32 is rotatably mounted in the housing 30 and operably connected to the latch bolt 31 such that rotation of the cam 32 causes retraction of the latch bolt 31. The cam 32 includes a square spindle-engaging hole 321 for receiving an end of the inside spindle 15 and an end of the outside spindle 25 such that rotation of either lever handle 11, 21 causes rotation of the cam 32. The housing 30 includes two engaging holes 33 and 34 through which the engaging posts 24 respectively extend, and two screws 14 are extended through holes 16 in the inside rose liner 13 into screw holes in the engaging posts 24, thereby securing the rose liners 13 and 23 together and engaging the inner and outer assemblies 1 and 2 with the latch mechanism 3.

The lever handle 11, 21 allows easy operation for a person that is handicapped in the hands or without hands. FIG. 2 is a sectional view of the lock in a latched state, and FIG. 3 is a sectional view of the lock in an unlatched state. Unlatching of the lock is attained when the lever handle 11, 21 is moved through 45 degrees. Nevertheless, rotation of the lever handle 11, 21 is a movement in a lower portion of a circle in which the arm of the user is moved inward. More specifically, it is not easy to apply force in such a posture. Further, a returning force is generated by a return spring in the lock when the lever handle 11, 21 reaches its end of the unlatching travel. This further increases difficulty to the user that is handicapped in the hands or without hands. Further, the engaging strength between the inner and outer assemblies 1 and 2 and the latch mechanism 3 by the engaging posts 24 is not strong enough and is thus apt to be destroyed.

SUMMARY OF THE INVENTION

An object of the present invention is to provide a cylindrical lock having an inside lever handle and an outside lever handle that incline upward and are at 45 degrees with a horizontal axis such that a person without hands may operate either lever handle easily.

Another object of the present invention is to provide a cylindrical lock having a reinforcing plate to reinforce the structure while allowing easy operation of either lever handle.

A lock in accordance with the present invention includes an inner assembly, an outer assembly, and a latch mechanism. The inner assembly includes an inside lever handle, an inside rose, an inside rose liner, and an inside spindle. The outer assembly includes an outside lever handle, an outside rose, an outside rose liner, and an outside spindle. Two engaging posts extend from the outside rose liner. The latch mechanism includes a housing and a latch bolt. The latch bolt is operably connected to the inside lever handle and the outside lever handle such that 45° rotation of either one of the inside lever handle and the outside lever handle causes retraction of the latch bolt into the housing.

A reinforcing plate includes two pegs respectively extending through two positioning holes of the housing. The reinforcing plate further includes a central hole through which the outside spindle extends. The reinforcing plate further includes a pair of slots through which the engaging posts extend. Two fasteners are extended through the inside rose liner and engaged with the engaging posts. Each of the inside lever handle and the outside lever handle are located in a position that inclines upward and at 45 degrees with a horizontal axis.

The reinforcing plate may further include another pair of slots. The engaging posts are selectively engaged in one of the two pairs of slots so as to be used with one of a left-handed door and a right-handed door.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
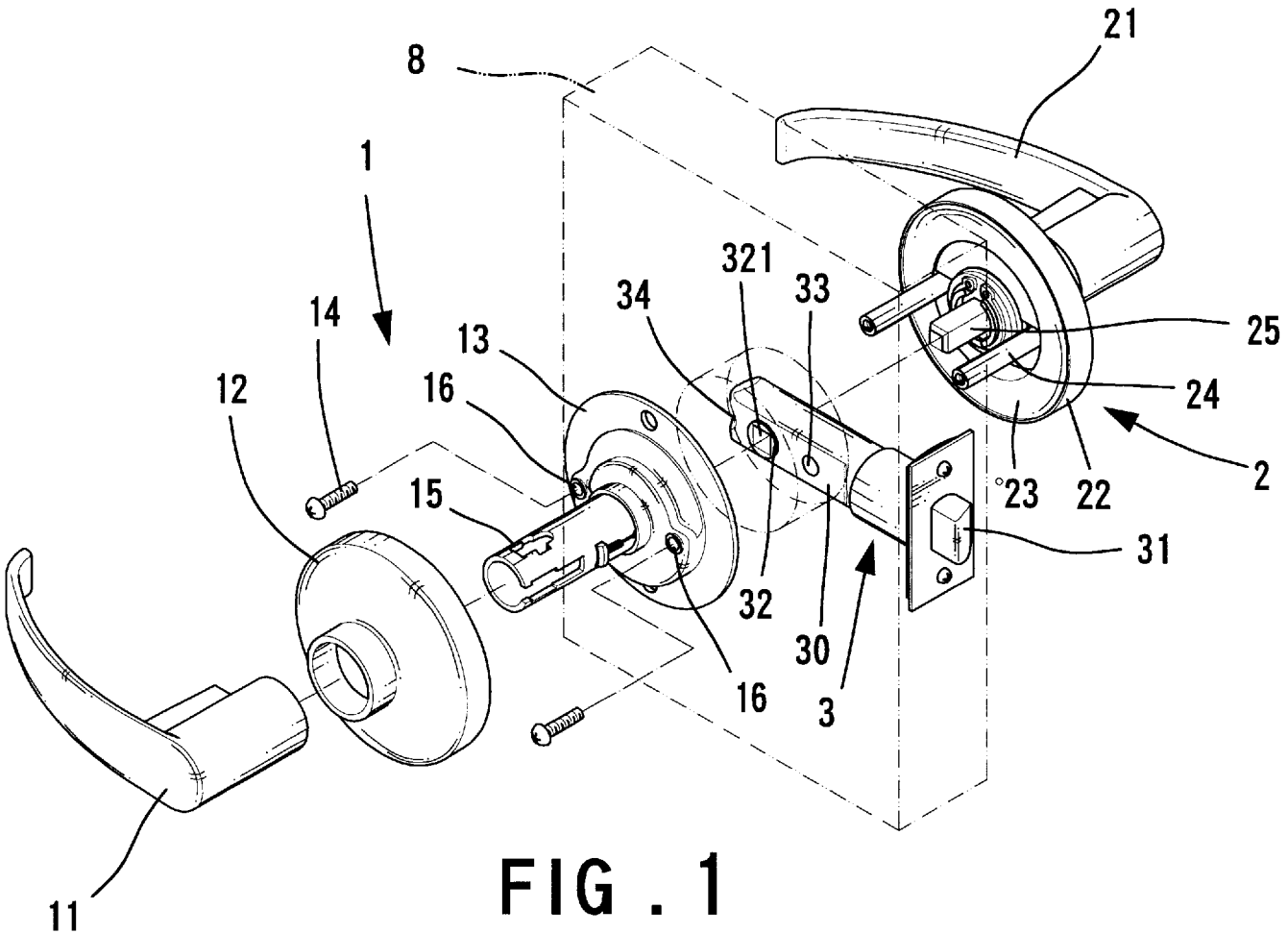
FIG. 1 PRIOR ART
FIG. 1 is an exploded perspective view of a conventional cylindrical lock.
Figure 2:
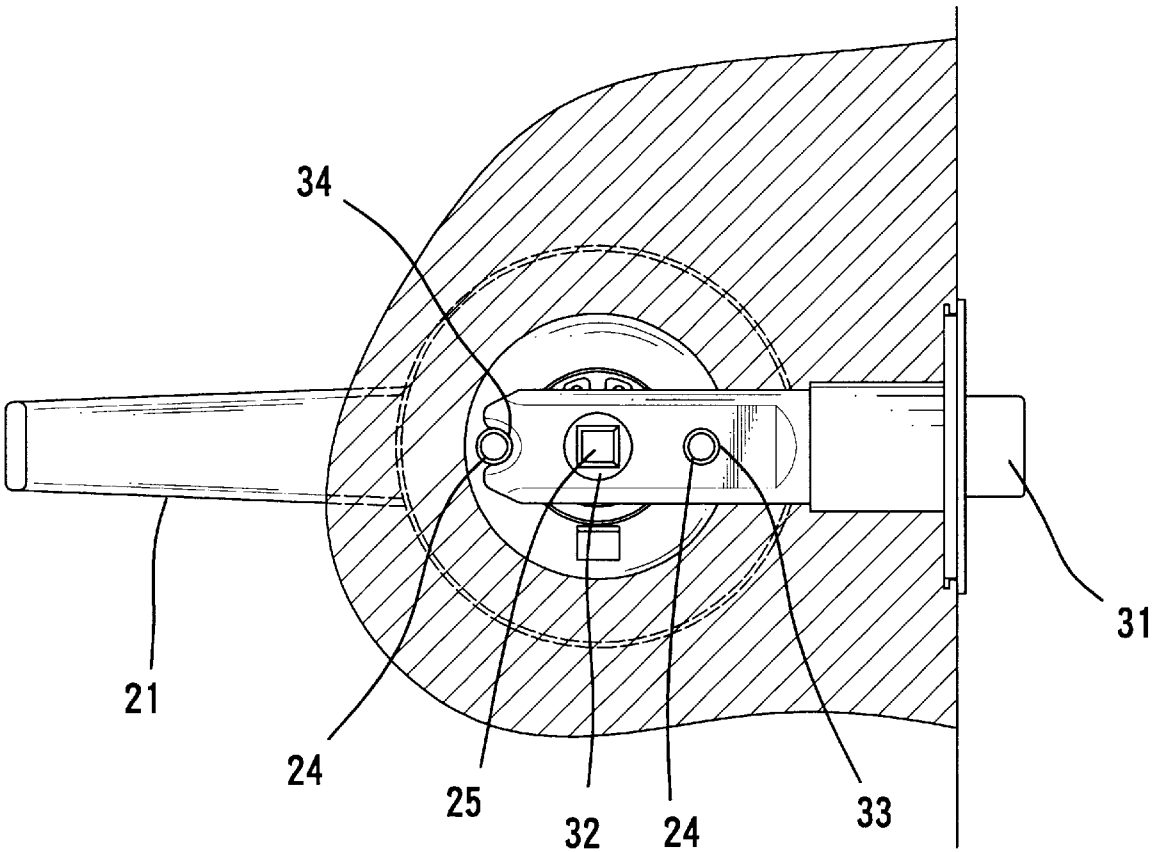
FIG. 2 PRIOR ART
FIG. 2 is a sectional view of the conventional cylindrical lock in a latched state.
Figure 3:
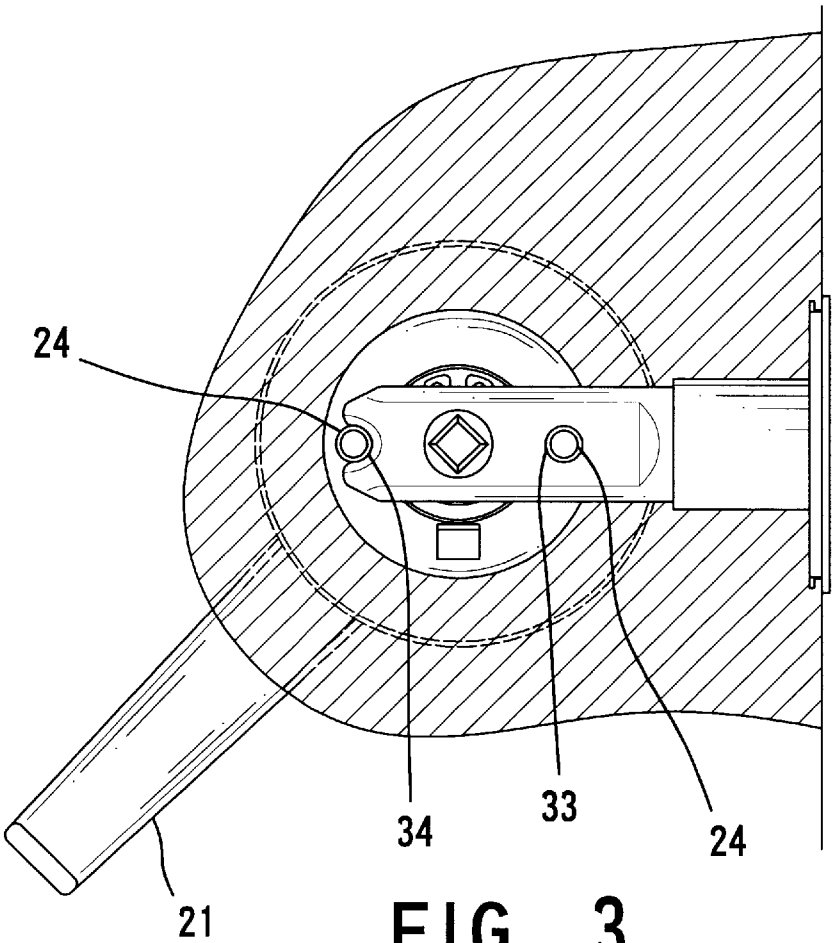
FIG. 3 PRIOR ART
FIG. 3 is a sectional view similar to FIG. 2, wherein the lock is in an unlatched state.
Figure 4:
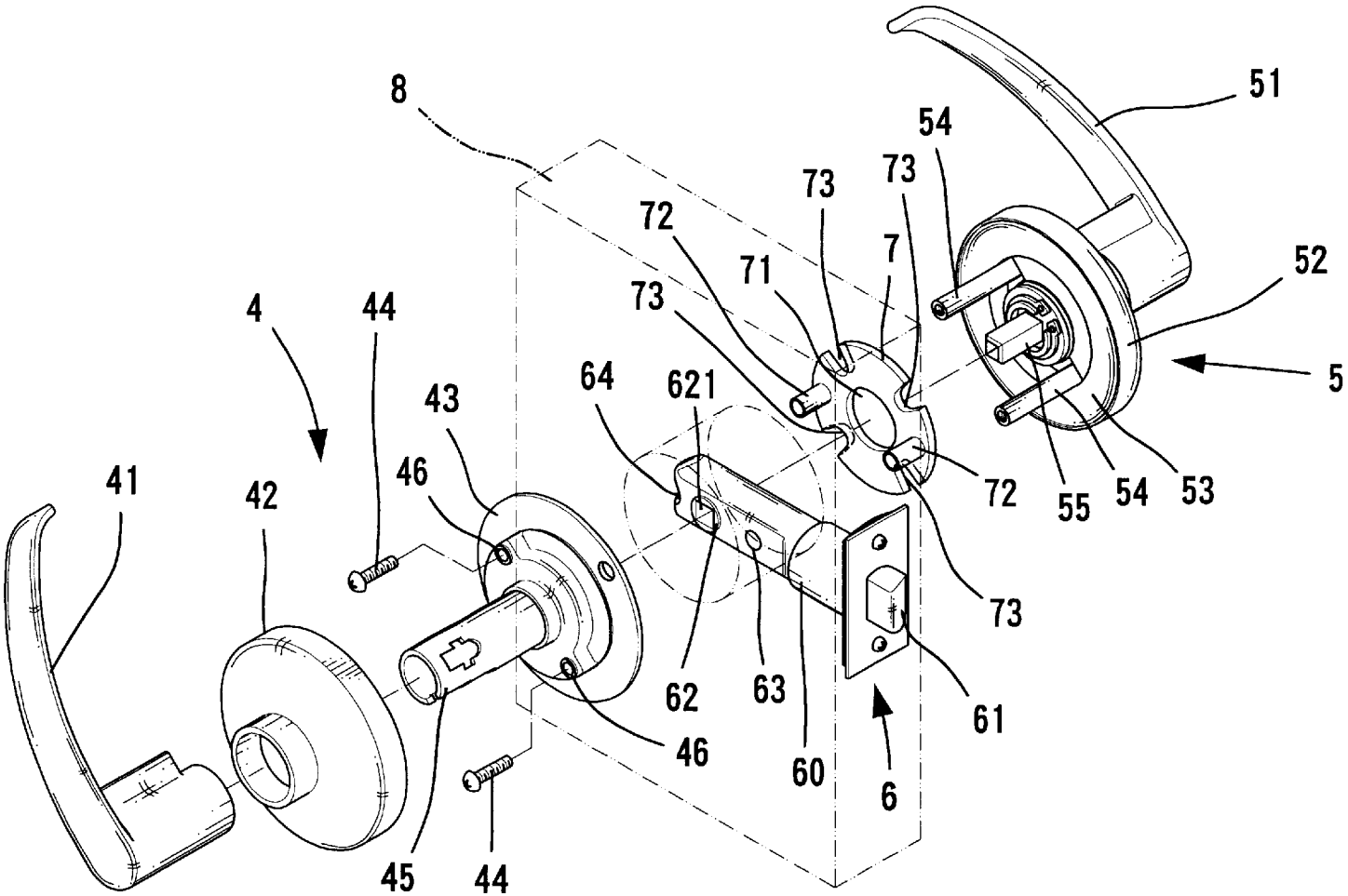
FIG. 4 is an exploded perspective view of a cylindrical lock in accordance with the present invention.
Figure 5:
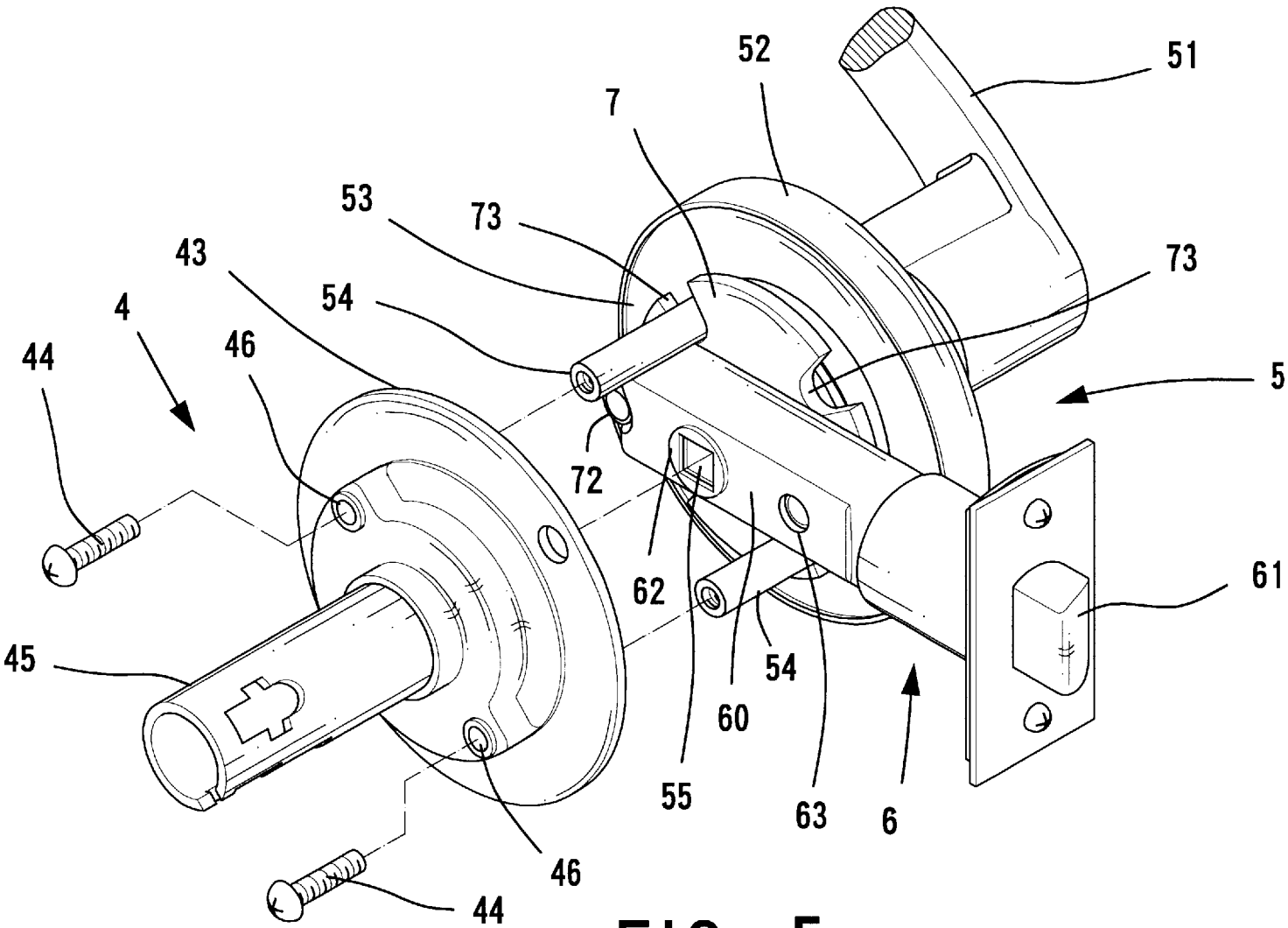
FIG. 5 is a perspective view, partly exploded, of the cylindrical lock in accordance with the present invention, wherein the outside lever handle and outside rose are removed for clarity.
Figure 6:
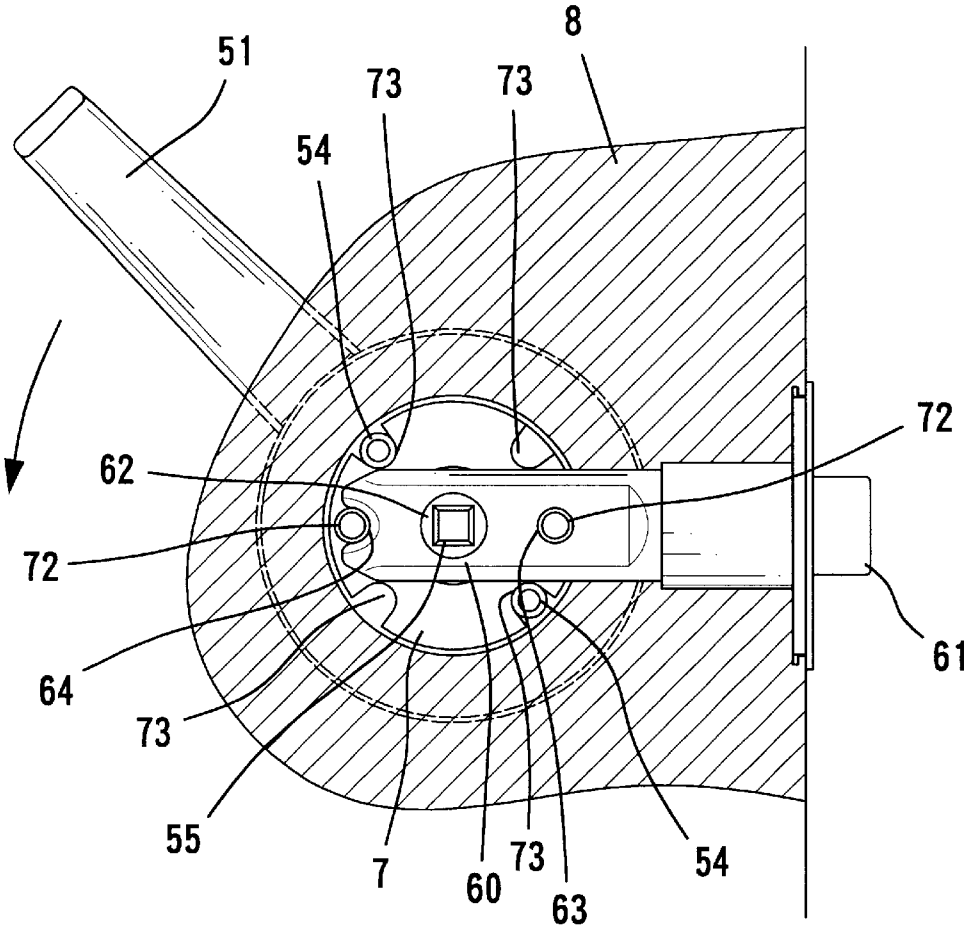
FIG. 6 is a sectional view of the cylindrical lock in a latched state.

Referring to FIGS. 4 through 6, a cylindrical lock in accordance with the present invention generally comprises an inner assembly 4, an outer assembly 5, and a latch mechanism 6. The inner assembly 4 includes an inside lever handle 41, an inside rose 42, an inside rose liner 43, and an inside spindle 45. The outer assembly 5 includes an outside lever handle 51, an outside rose 52, an outside rose liner 53, and an inside spindle 55. Two engaging posts 54 are mounted to an inner side of the outside rose liner 53.

Figure 8:
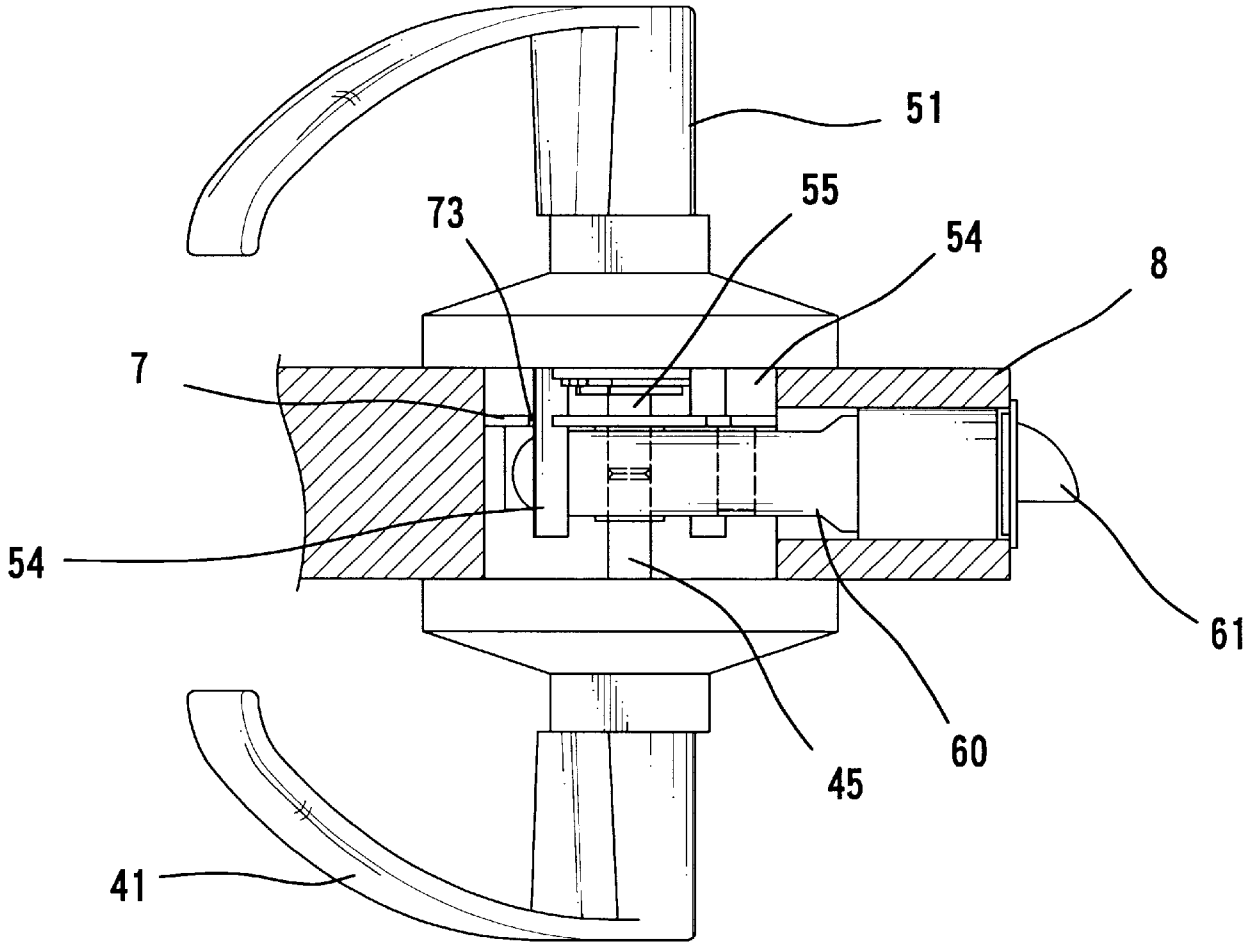
FIG. 8 is a top view, partly sectioned, of the cylindrical lock in accordance with the present invention.

The latch mechanism 6 is mounted in a door 8 and includes a housing 60 and a latch bolt 61. A cam 62 is rotatably mounted in the housing 60 and operably connected to the latch bolt 61 such that rotation of the cam 62 causes retraction of the latch bolt 61. The cam 62 includes a square spindle-engaging hole 621 for receiving an end of the inside spindle 45 and an end of the outside spindle 55 (see FIG. 8) such that rotation of either lever handle 41, 51 causes rotation of the cam 62. The housing 60 includes two engaging holes 63 and 64.

The cylindrical lock further comprises a reinforcing plate 7 including a central hole 71 through which the outside spindle 55 extends, two pegs 72 respectively extending through the positioning holes 63 and 64 of the housing 60, and two pairs of holes or slots 73 that are spaced from the pegs 72 by 45 degrees.

In assembly, the pegs 72 of the reinforcing plate 7 are extended through the positioning holes 63 and 64, and the engaging posts 54 are extended through one pair of the slots 73. The engaging posts 54 are sized to be fittingly engaged in the slots 73. Two fasteners such as screws 44 are extended through holes 46 in the inside rose liner 43 and into screw holes (not labeled) in the engaging posts 54. After assembly, both of the inside lever handle 41 and the outside lever handle 51 incline upward and are at 45 degrees with the horizontal axis, best shown in FIG. 6.

Figure 7:
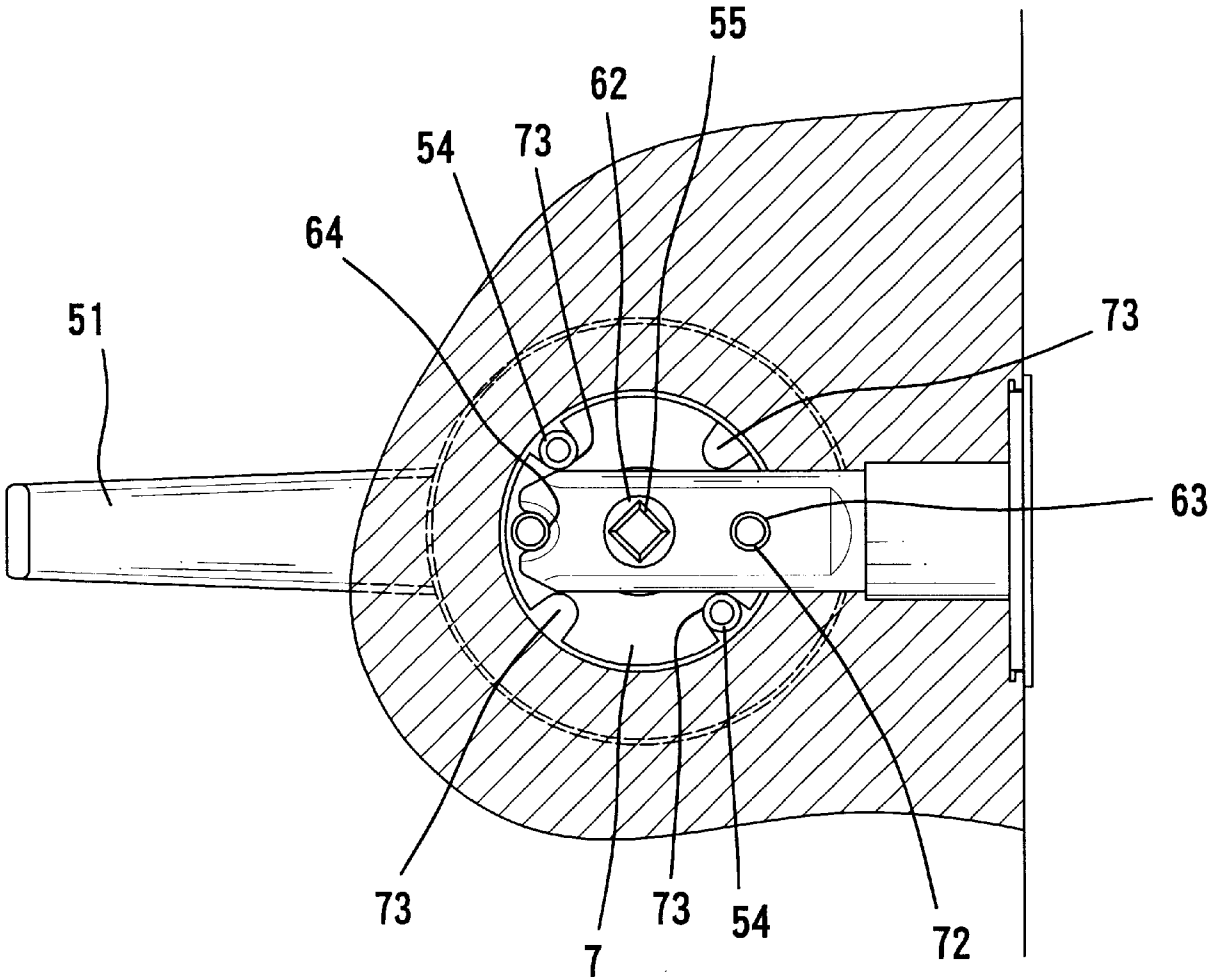
FIG. 7 is a sectional view similar to FIG. 6, wherein the lock is in an unlatched state.

The lever handle 41, 51 allows easy operation for a person that is handicapped in the hands or without hands. FIG. 6 is a sectional view of the lock in a latched state, and FIG. 7 is a sectional view of the lock in an unlatched state. The lever handle 41, 51 in FIG. 6 is pressed downward through 45 degrees to a position shown in FIG. 7 in which unlatching of the lock is attained. Rotation of the lever handle 41, 51 is a movement in an upper portion of a circle in which the arm of the user is moved outward. It is easy for the handicapped to apply force in such a posture. Further, the weight of a leaning user aids in overcoming a returning force generated by a return spring in the lock when the lever handle 41, 51 reaches its end of the unlatching travel. This further eliminates door-opening difficulty to the user that is handicapped in the hands or without hands. Further, the engaging strength between the inner and outer assemblies 1 and 2 and the latch mechanism 3 is improved by the reinforcing plate 7 that has two pegs 72 extending through the positioning holes 63 and 64 of the housing 60 while the engaging posts 54 are extended through one pair of the slots 73 of the reinforcing plate 7.

Figure 9:
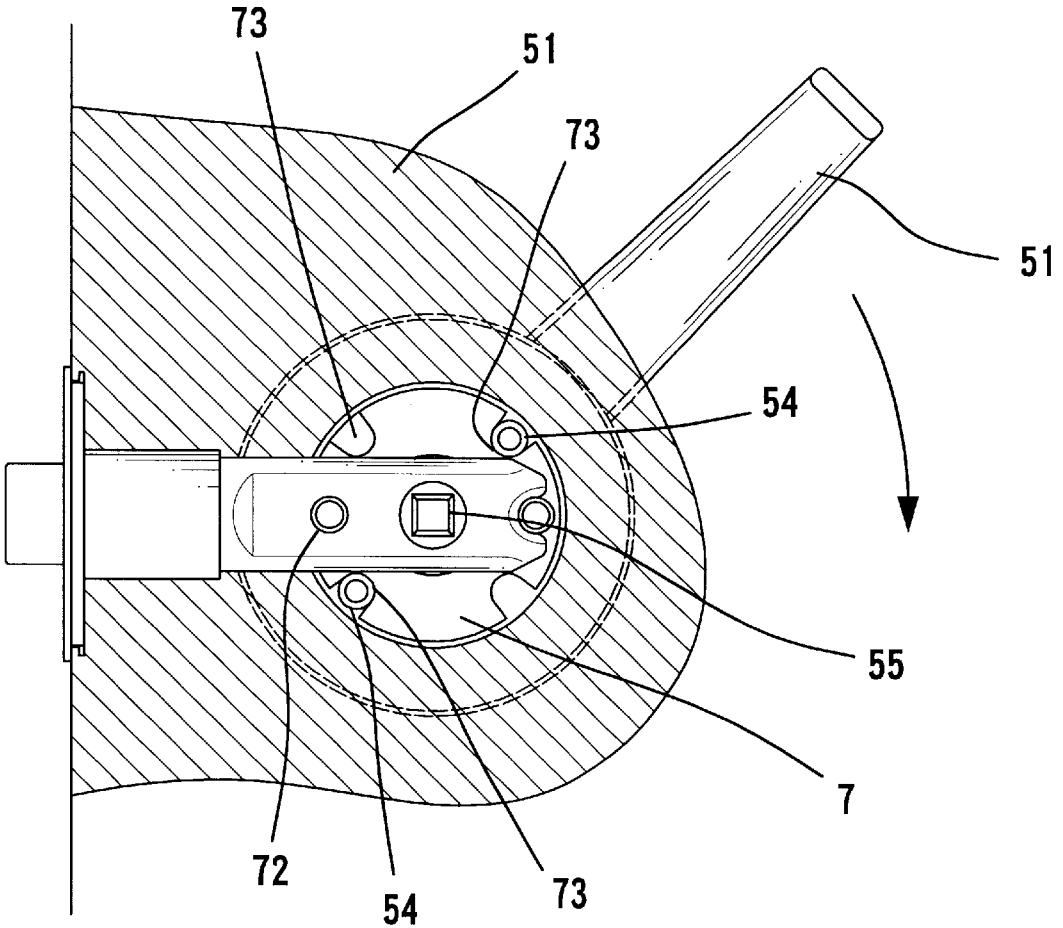
FIG. 9 is a sectional view of another embodiment of the cylindrical lock in accordance with the present invention.

The cylindrical lock in accordance with the present invention can be used with either a left-handed door or a right-handed door. FIG. 6 illustrates use of the cylindrical lock with a right-handed door. FIG. 9 illustrates use of the cylindrical lock with a left-handed door in which the engaging posts 54 are extended through the other pair of slots 73 of the reinforcing plate 7.

The reinforcing plate 7 and the upward inclination of either lever handle 41, 51 can be used with various cylindrical locks having lever handles. For example, the housing 60 may include split cams 62 for respectively receiving an end of an inside spindle and an end of an outside spindle.

Although the invention has been explained in relation to its preferred embodiments, it is to be understood that many other possible modifications and variations can be made without departing from the scope of the invention as hereinafter claimed.

What is claimed is:

1. A lock comprising:

an inner assembly including an inside lever handle, an inside rose, an inside rose liner, and an inside spindle, the inside lever handle having a rectilinear section for manual operation;

an outer assembly including an outside lever handle, an outside rose, an outside rose liner, and an outside spindle, the outside lever handle having a rectilinear section for manual operation, two engaging posts extending from said outside rose liner;

a latch mechanism including a housing and a latch bolt, said housing including two positioning holes, said latch bolt being operably connected to said inside lever handle and said outside lever handle such that rotation of either one of said inside lever handle and said outside lever handle causes retraction of said latch bolt into said housing from an extended position; a reinforcing plate including two pegs respectively extending through said positioning holes of said housing, said reinforcing plate further including a central hole through which said outside spindle extends, said reinforcing plate further including a pair of slots through which said engaging posts extend, wherein said pair of slots are spaced from the pegs by an acute angle; and two fasteners extended through said inside rose liner and engaged with said engaging posts;

when the latch bolt being in the extended position, the rectilinear section of each of said inside lever handle and said outside lever handle being located in a position corresponding to the acute angle with a horizontal axis.

2. The lock as claimed in claim 1, wherein said reinforcing plate includes another pair of slots, said engaging posts being selectively engaged in one of said pairs of slots and said another pair of slots so as to be used with one of a left-handed door and a right-handed door.

3. The lock as claimed in claim 2, wherein said pair of slots are spaced from said another pair of slots by 90°.

4. The lock as claimed in claim 3, wherein said pair of slots are spaced from the pegs by 45°, with the position of each of said inside lever handle and the outside lever handle inclined upward and at 45° with a horizontal axis.

5. The lock as claimed in claim 4, wherein said reinforcing plate includes an outer periphery, with said pair of slots formed in the outer periphery and spaced from the central hole.

6. The lock as claimed in claim 5, wherein the pair of slots and the two pegs are at equal radial spacings from the central hole.

7. The lock as claimed in claim 1, wherein said pair of slots are spaced from the pegs by 45°, with the position of each of said inside lever handle and the outside lever handle inclined upward and at 45° with a horizontal axis.

8. The lock as claimed in claim 7, wherein said reinforcing plate includes an outer periphery; with said pair of slots formed in the outer periphery and spaced from the central hole.

9. The lock as claimed in claim 8, wherein the pair of slots and the two pegs are at equal radial spacings from the central hole.

10. The lock as claimed in claim 1, wherein said reinforcing plate includes an outer periphery, with said pair of slots formed in the outer periphery and spaced from the central hole.

11. The lock as claimed in claim 10, wherein the pair of slots and the two pegs are at equal radial spacings from the central hole.

12. The lock as claimed in claim 1, wherein the pair of slots and the two pegs are at equal radial spacings from the central hole.

* * * * *